US009255564B2

(12) United States Patent
Toyoshima et al.

(10) Patent No.: US 9,255,564 B2
(45) Date of Patent: Feb. 9, 2016

(54) GLOW PLUG TIP TEMPERATURE ESTIMATING METHOD AND GLOW PLUG DRIVE CONTROL DEVICE

(75) Inventors: Yasuo Toyoshima, Saitama (JP); Katsumi Takatsu, Saitama (JP)

(73) Assignee: Bosch Corporation, Tokyo (JP)

( * ) Notice: Subject to any disclaimer, the term of this patent is extended or adjusted under 35 U.S.C. 154(b) by 812 days.

(21) Appl. No.: 13/349,381

(22) Filed: Jan. 12, 2012

(65) Prior Publication Data

US 2012/0175360 A1 Jul. 12, 2012

(30) Foreign Application Priority Data

Jan. 12, 2011 (JP) ..... 2011-003773

(51) Int. Cl.
*F23Q 7/22* (2006.01)
*F02P 19/02* (2006.01)
*F02D 41/24* (2006.01)

(52) U.S. Cl.
CPC ..... *F02P 19/025* (2013.01); *F02D 41/2451* (2013.01)

(58) Field of Classification Search
CPC ..... F02P 5/1502; F02P 19/021; F02P 19/026; F02P 19/025; F02D 9/04; F02D 41/006; F02D 41/0065; F02D 41/402; F02M 25/0711; F02M 25/0713; F02M 25/0731; F02M 25/0752
USPC ..... 219/205, 208, 260, 262–264, 267, 268, 219/270, 492–500; 123/179.1–179.27
See application file for complete search history.

(56) References Cited

U.S. PATENT DOCUMENTS

| | | | | | |
|---|---|---|---|---|---|
| 2,840,067 | A | * | 6/1958 | Carlson | 123/145 A |
| 4,162,669 | A | * | 7/1979 | Igashira et al. | 123/210 |
| 4,487,169 | A | * | 12/1984 | Slezak et al. | 123/41.33 |
| 4,607,153 | A | * | 8/1986 | Ang et al. | 219/497 |
| 4,639,871 | A | * | 1/1987 | Sakai et al. | 701/113 |
| 4,669,430 | A | * | 6/1987 | Reinold et al. | 123/179.6 |
| 4,778,377 | A | * | 10/1988 | Kawamura | 431/41 |
| 4,892,476 | A | * | 1/1990 | Kawamura | 431/36 |
| 5,094,198 | A | * | 3/1992 | Trotta et al. | 123/179.21 |
| 5,144,922 | A | * | 9/1992 | Kong | 123/145 A |
| 5,206,483 | A | * | 4/1993 | Aota | 219/270 |
| 5,231,962 | A | * | 8/1993 | Osuka et al. | 123/299 |
| 5,285,640 | A | * | 2/1994 | Olivo | 60/274 |
| 5,287,831 | A | * | 2/1994 | Andersen et al. | 123/179.3 |
| 5,327,870 | A | * | 7/1994 | Boisvert et al. | 123/145 A |

(Continued)

FOREIGN PATENT DOCUMENTS

| | | |
|---|---|---|
| EP | 0315034 | 5/1989 |
| JP | 5968569 | 4/1984 |

(Continued)

*Primary Examiner* — Eric Stapleton
(74) *Attorney, Agent, or Firm* — Michael Best & Friedrich LLP

(57) ABSTRACT

An arithmetic and control unit is configured to calculate a resistance value of a glow plug on the basis of an energization current of the glow plug and a voltage applied to the glow plug, perform a multiplication of the resistance value and a constant that has been determined beforehand on the basis of an electrical characteristic of the glow plug, input a predetermined heater reference point temperature, calculate an offset with a predetermined offset arithmetic expression from the heater reference point temperature, correct the multiplication result with that offset, and take the correction result as an estimated temperature of a tip of the glow plug.

4 Claims, 8 Drawing Sheets

(56) References Cited

U.S. PATENT DOCUMENTS

| | | | | |
|---|---|---|---|---|
| 5,617,819 | A * | 4/1997 | Dery et al. | 123/179.2 |
| 5,729,456 | A * | 3/1998 | Boisvert et al. | 701/99 |
| 5,823,155 | A * | 10/1998 | Burner | 123/145 A |
| 6,009,369 | A * | 12/1999 | Boisvert et al. | 701/99 |
| 6,148,258 | A * | 11/2000 | Boisvert et al. | 701/99 |
| 6,247,300 | B1 * | 6/2001 | Muramatsu et al. | 60/39.091 |
| 6,878,903 | B2 * | 4/2005 | Duba | 219/270 |
| 7,431,004 | B2 * | 10/2008 | Kernwein et al. | 123/145 A |
| 7,512,469 | B2 * | 3/2009 | Tohdo et al. | 701/48 |
| 7,631,625 | B2 * | 12/2009 | De Pottey | 123/179.21 |
| 7,957,885 | B2 * | 6/2011 | Kernwein et al. | 701/102 |
| 8,115,144 | B2 * | 2/2012 | Cassani et al. | 219/497 |
| 2001/0050275 | A1 * | 12/2001 | Uhl | 219/270 |
| 2004/0255889 | A1 * | 12/2004 | Kumada et al. | 123/179.6 |
| 2005/0081812 | A1 * | 4/2005 | Toedter et al. | 123/145 A |
| 2006/0102611 | A1 * | 5/2006 | Reissner et al. | 219/270 |
| 2006/0272212 | A1 * | 12/2006 | Edlund | 48/197 R |
| 2006/0289425 | A1 * | 12/2006 | Serra et al. | 219/270 |
| 2008/0302777 | A1 * | 12/2008 | Ando | 219/270 |
| 2009/0070020 | A1 * | 3/2009 | Tetsuno | 701/113 |
| 2009/0151338 | A1 * | 6/2009 | Li et al. | 60/295 |
| 2009/0183718 | A1 * | 7/2009 | Casasso et al. | 123/623 |
| 2009/0194070 | A1 * | 8/2009 | Dittus et al. | 123/406.55 |
| 2009/0289048 | A1 * | 11/2009 | Casasso et al. | 219/262 |
| 2009/0289051 | A1 * | 11/2009 | Cassani et al. | 219/497 |
| 2009/0294431 | A1 * | 12/2009 | Sakurai | 219/268 |
| 2010/0312416 | A1 * | 12/2010 | Demirdelen | 700/300 |
| 2014/0216384 | A1 * | 8/2014 | Tanaka et al. | 123/179.6 |

FOREIGN PATENT DOCUMENTS

| | | |
|---|---|---|
| JP | 2001-336468 | 7/2001 |
| JP | 2009168319 | 7/2009 |
| WO | 0142715 | 6/2001 |

* cited by examiner

GLOW PLUG TIP TEMPERATURE ESTIMATING METHOD AND GLOW PLUG DRIVE CONTROL DEVICE

BACKGROUND OF THE INVENTION

The invention pertains to a method of estimating the temperature of the tip of a glow plug and particularly relates to the acquisition, by a simple method, of an estimated temperature of the tip of a glow plug used in an internal combustion engine or the like and an improvement in the precision thereof.

Conventionally, it has been well known that the temperature of the tip of a glow plug used in an internal combustion engine such as a diesel engine is an element that is important as a parameter for controlling the energized state of the glow plug itself.

For this reason, for example, various devices in which a thermocouple is built into the tip portion of the glow plug and which make the temperature of the tip portion directly acquirable and supply the temperature for engine control, and various methods of estimating the temperature of the tip of the glow plug from the resistance value of the glow plug at the time of energization, have been proposed, for example, in JP-A-2001-336468 and etc.

However, in the configuration described above where a thermocouple is disposed in the tip portion of the glow plug to detect the temperature of the tip portion, an adhesive secures the thermocouple, and there is no adhesive whose upper temperature limit is sufficient. In addition, the consistency between the coefficient of thermal expansion of the adhesive and the coefficient of thermal expansion of the thermocouple is not always good. So there are worries that the thermocouple will become disconnected or separate from the place to which it is adhered. And in addition to the problem that the configuration is less than perfect in terms of its solidness, there are also the problems that the configuration of the glow plug itself becomes complicated and expensive.

Further, in conventional methods of estimating the temperature of the tip of the glow plug from the resistance value of the glow plug, the heat transfer environment around the glow plug changes depending on the load and speed of the engine, which in no small way affects the resistance value of the glow plug. So there is the problem that the precision of estimation is not always sufficient.

SUMMARY OF THE INVENTION

The present invention has been made in light of the above circumstances and provides a glow plug tip temperature estimating method and a glow plug drive control device that can extremely simply and precisely estimate the temperature of the tip of a glow plug.

According to a first aspect of the invention, there is provided a glow plug tip temperature estimating method pertaining to the present invention comprising: correcting, with an offset that has been obtained on the basis of a predetermined heater reference point temperature, the result of multiplying a resistance value of a glow plug that has been actually measured and a constant that has been determined on the basis of an electrical characteristic of the glow plug; and taking the result of that correction as an estimated temperature of the tip of the glow plug.

According to a second aspect of the invention, there is a glow plug drive control device pertaining to the present invention comprising: an arithmetic and control unit that executes drive control of a glow plug; and an energization drive circuit that performs energization of the glow plug in response to the drive control of the glow plug that is executed by the arithmetic and control unit, wherein the arithmetic and control unit is configured to arithmetically calculate a resistance value of the glow plug on the basis of an energization current of the glow plug and a voltage applied to the glow plug, perform a multiplication of the resistance value of the glow plug that has been calculated and a constant that has been determined beforehand on the basis of an electrical characteristic of the glow plug, input a predetermined heater reference point temperature, calculate an offset with a predetermined offset arithmetic expression from the heater reference point temperature, correct the multiplication result with that offset, and calculate an estimated temperature of a tip of the glow plug.

DETAILED DESCRIPTION OF THE PREFERRED EMBODIMENTS

An embodiment of the invention will be described below with reference to FIG. 1 to FIG. 8.

It will be noted that the members and arrangements described below are not intended to limit the present invention and can be variously modified within the scope of the gist of the present invention.

First, an example configuration of a glow plug 1 in the embodiment of the present invention will be described with reference to FIG. 1 and FIG. 2.

Figure 1:
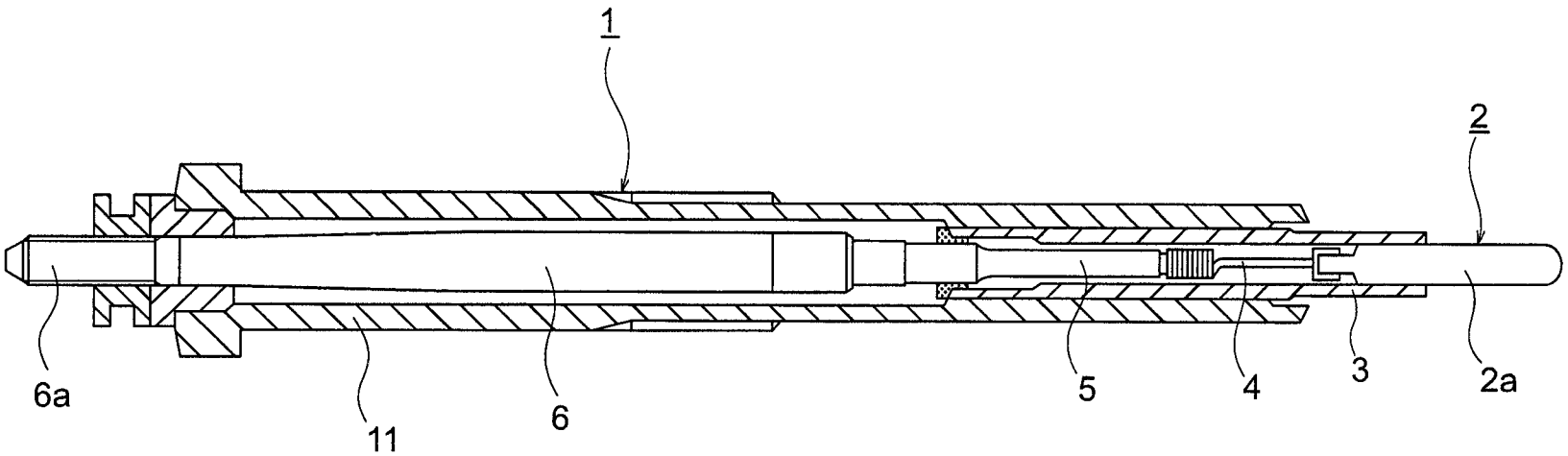
FIG. 1 is a longitudinal sectional view showing an example configuration of a glow plug to which a glow plug tip temperature estimating method in an embodiment of the present invention is applied.
Figure 2:
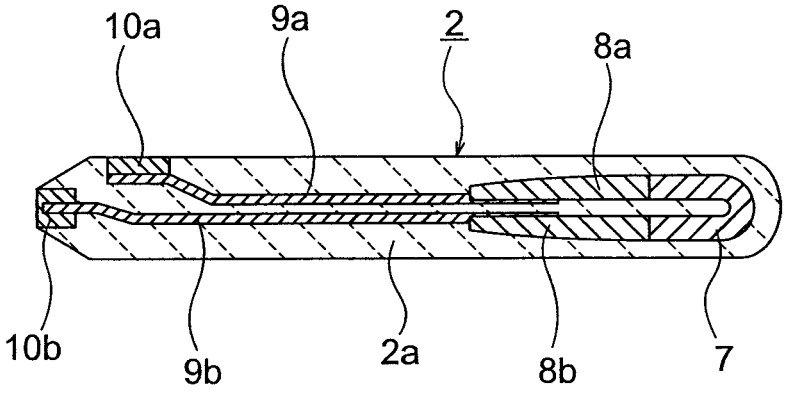
FIG. 2 is a schematic diagram showing an example configuration of a ceramic heater for the glow plug shown in FIG. 1.

The glow plug 1 shown in FIG. 1 and FIG. 2 is an example configuration of a ceramic glow plug. The basic configuration thereof is basically the same as that of a conventionally known ceramic glow plug and will be generally described below.

The glow plug 1 is configured as a result of a ceramic heater 2, a metal sheath 3, an electrode lead wire 4, an electrode lead rod 5, and an external connection terminal 6 being inserted into and secured inside a housing 11 (see FIG. 1).

The ceramic heater 2 in the embodiment of the present invention has a configuration called a thin-film heating element single-layer type. That is, the ceramic heater 2 is configured as a result of a heating element 7 being buried inside a ceramic insulator 2*a*. The negative electrode side of the heating element 7 is electrically connected and led, via a negative electrode-side ceramic lead portion 8*a* and a negative electrode-side metal lead portion 9*a*, to a negative electrode-side electrode lead member 10*a* that is attached to the outer peripheral surface of the ceramic insulator 2*a* (see FIG. 2). The negative electrode-side electrode lead member 10*a* is electrically connected to the metal sheath 3.

The positive electrode side of the heating element 7 is also, like the negative electrode side, electrically connected and led, via a positive electrode-side ceramic lead portion 8*b* and a positive electrode-side metal lead portion 9*b*, to a positive electrode-side electrode lead member 10*b* on the back end side (the opposite side of the site where the heating element 7 is positioned) of the ceramic insulator 2*a* (FIG. 2).

The positive electrode-side electrode lead member 10*b* is configured such that a screw portion 6*a* of the external connection terminal 6 that projects from the back end portion side of the housing 11 is connected to an unillustrated battery via the electrode lead wire 4, the electrode lead rod 5, and the external connection terminal 6, which comprise conductive members (see FIG. 1).

It is not invariably necessary for the ceramic heater 2 to be limited to the thin-film heating element single-layer type described above. The ceramic heater 2 may also be one having another configuration, such as a configuration called a thin-film heating element two-layer type where the heating element is buried in two layers or a configuration that uses a bulk heating element.

Next, a glow plug drive control device 100 (called "the GCU 100" below) in the embodiment of the present invention will be described with reference to FIG. 3.

The GCU 100 in the embodiment of the present invention is broadly divided into and configured by an energization drive circuit 21, a measurement circuit 22, and an arithmetic and control unit (abbreviated as "CPU" in FIG. 4) 23.

The energization drive circuit 21 takes as its main components an energization control-use semiconductor element 31 and a resistor 32 and is configured to perform energization control of the glow plug 1.

AMOS FET or the like, for example, is used for the energization control-use semiconductor element 31. The drain of the energization control-use semiconductor element 31 is connected to a positive electrode of a vehicle battery 25, and the source of the energization control-use semiconductor element 31 is connected to the screw portion 6*a* of the glow plug 1 via the resistor 32. A control signal from the arithmetic and control unit 23 is applied to the gate of the energization control-use semiconductor element 31, whereby the making and breaking of electrical continuity of the energization control-use semiconductor element 31 is controlled. The energization of the glow plug 1 is controlled by this electrical continuity control of the energization control-use semiconductor element 31. The energization control by the energization drive circuit 21 and the arithmetic and control unit 23 is basically the same as conventional.

Additionally, a heating element negative electrode connecting portion 3*a* disposed on the metal sheath 3 (see FIG. 1) to which the negative electrode side of the heating element 7 of the glow plug 1 is connected is connected to a ground.

Figure 3:
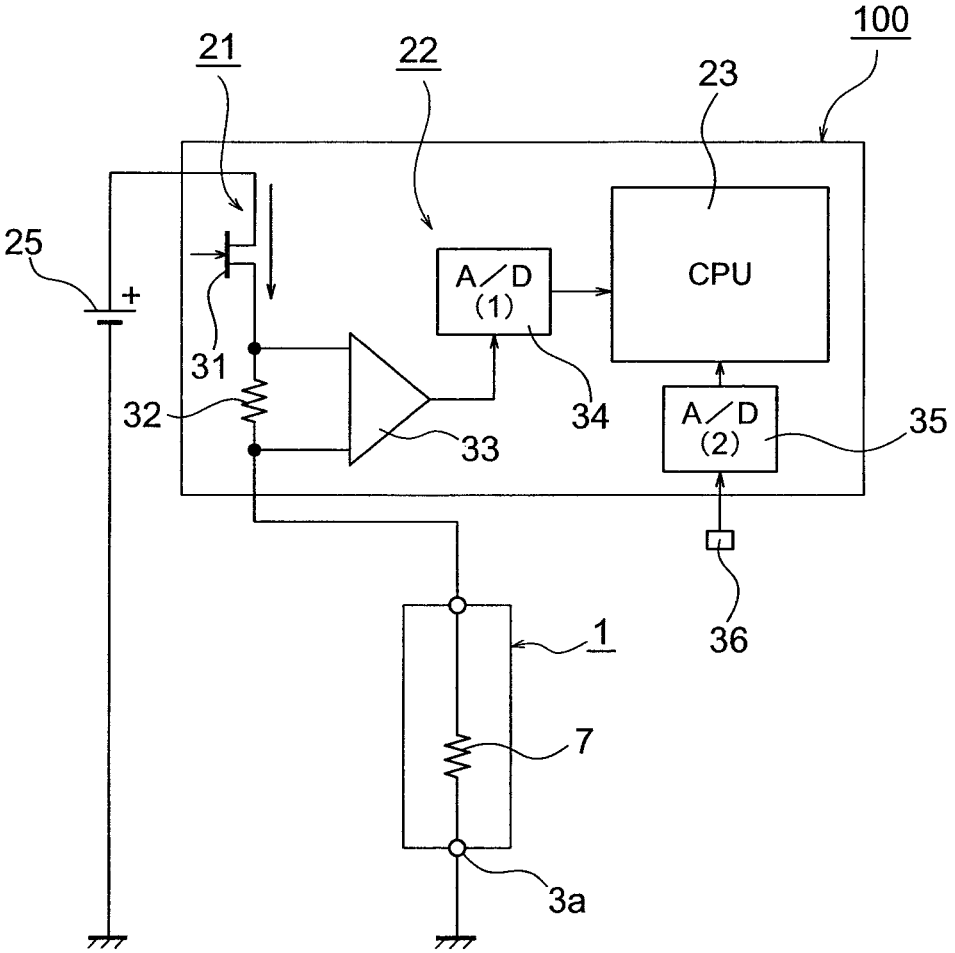
FIG. 3 is a diagram showing an example configuration of a glow plug drive control device to which the glow plug tip temperature estimating method in the embodiment of the present invention is applied.

The measurement circuit 22 takes as its main components an op-amp 33 and a first analog-to-digital converter (abbreviated as "A/D (1)" in FIG. 3) 34 and is configured to be capable of inputting to the arithmetic and control unit 23 the voltage drop in the resistor 32 that is proportional to the current flowing in the glow plug 1.

The voltages of both ends of the resistor 32 are inputted to the op-amp 33. The output voltage of the op-amp 33 is inputted to the arithmetic and control unit 23 as a digital value by the analog-to-digital converter 34.

The arithmetic and control unit 23 uses a predetermined arithmetic expression to divide the value of the voltage drop in the resistor 32 that has been digitally inputted as described above by the resistance value of the resistor 32. The division result is stored in an appropriate storage region as the current flowing in the glow plug 1.

The arithmetic and control unit 23 takes as its main components and is configured by, for example, a microcomputer (not shown) having a publicly-known well-known configuration, storage elements (not shown) such as a RAM and a ROM, and an interface circuit (not shown) for outputting the aforementioned control signal to the energization control-use semiconductor element 31.

The output of a thermocouple 36 is inputted to the arithmetic and control unit 23 via a second analog-to-digital converter (abbreviated as "A/D (2)" in FIG. 3) and is supplied for later-described glow plug tip temperature estimation processing.

The thermocouple 36 is for detecting a heater reference point temperature that becomes necessary for the later-described glow plug tip temperature estimation processing. In the embodiment of the present invention, the thermocouple 36 is attached to an appropriate site on the heating element negative electrode connecting portion 3*a* of the glow plug 1 and detects the temperature of that portion.

Next, a first example of the glow plug tip temperature estimation processing that is executed by the arithmetic and control unit 23 will be described with reference to the subroutine flowchart shown in FIG. 4.

First, it is assumed that energization drive control processing of the glow plug 1 is executed like conventionally in the GCU 100. The energization drive control processing controls the energization of the glow plug 1—in other words, the making and breaking of electrical continuity of the energization control-use semiconductor element 31—depending on the driven state of an unillustrated engine. In the energization drive control processing, the making and breaking of electrical continuity of the energization control-use semiconductor element 31 is performed by pulse width modulation (PWM) control, for example.

Figure 4:
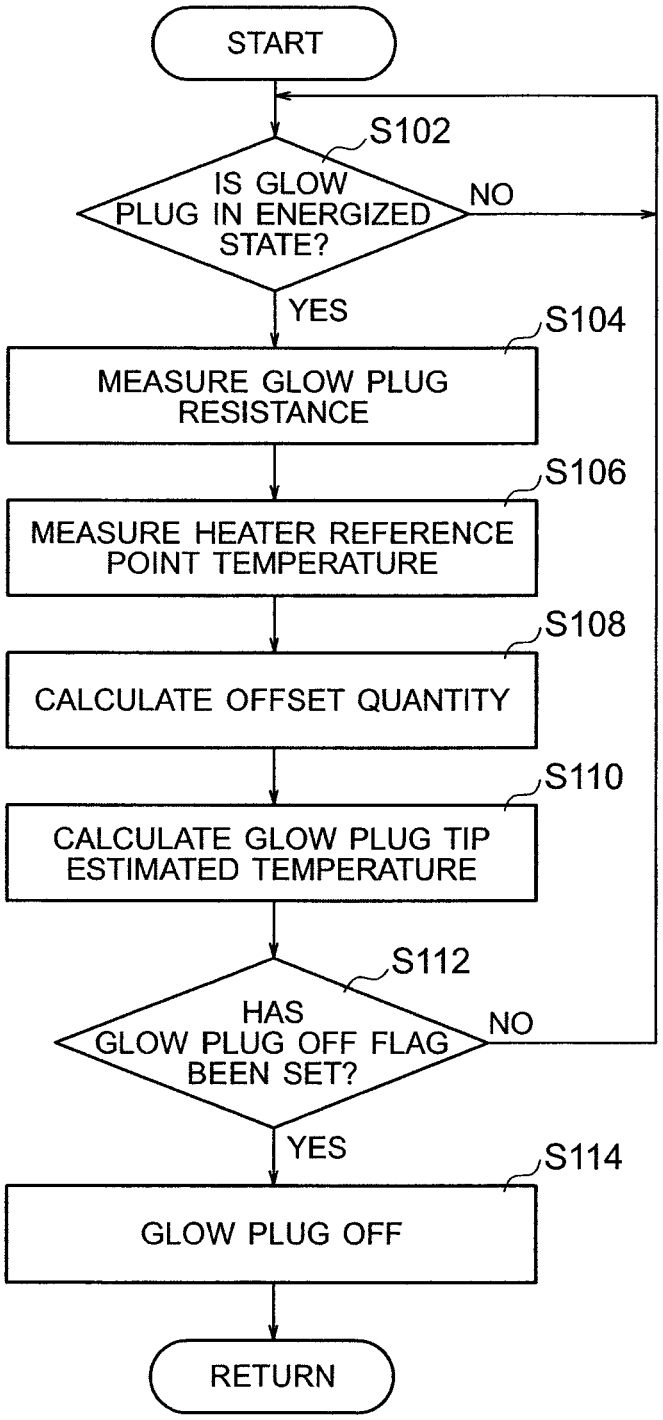
FIG. 4 is a subroutine flowchart showing a procedure in a first example of glow plug tip temperature estimation process that is executed by the glow plug drive control device shown in FIG. 3.

Then, when processing is started by the arithmetic and control unit 23, first, it is determined whether or not the glow plug 1 is ON, that is, whether or the glow plug 1 is being energized (see step S102 in FIG. 4). The arithmetic and control unit 23 advances to the processing in next-described step S104 only in a case where it has been determined that the glow plug 1 is being energized (in the case of YES). In a case where it has been determined that the glow plug 1 is not yet being energized (in the case of NO), the determination processing is repeated until it is determined that the glow plug 1 is being energized.

In step S104, a measurement of the resistance of the glow plug 1 is executed.

That is, a resistance value Rg of the glow plug 1 is arithmetically calculated as $Rg=(VB-Vr)\div(Vr\div R)$ by the arithmetic and control unit 23.

Here, VB is the voltage of the vehicle battery 25, Vr is the voltage drop in 25 the resistor 32, and R is the resistance value of the resistor 32. Further, this arithmetic expression assumes that the voltage drop in the energization control-use semiconductor element 31 can be ignored.

The voltage drop Vr in the resistor 32 is acquired via the measurement circuit 22.

Next, a measurement of a heater reference point temperature is performed (see step S106 in FIG. 4).

Here, the heater reference point temperature is necessary as a parameter for determining an offset quantity that is used in later-described glow plug tip temperature calculation processing (see step S110 in FIG. 4).

Specifically, the heater reference point temperature in the embodiment of the present invention is the temperature of the heating element negative electrode connecting portion 3*a* (see FIG. 3) that is connected to the negative electrode-side electrode lead member 10*a*. The thermocouple 36 (see FIG. 3) is attached to this site, and the temperature of that site is made measureable in the arithmetic and control unit 23.

The heater reference point temperature is not limited to the heating element negative electrode connecting portion 3*a* and may of course also be another arbitrary site on the glow plug 1. For example, an appropriate site on the metal sheath 3 outside the heating element negative electrode connecting portion 3*a* is suitable.

Next, an offset quantity calculation is performed (see step S108 in FIG. 4), and a calculation of the glow plug tip temperature (estimated temperature) is performed using this offset quantity (see step S110 in FIG. 4).

First, in the embodiment of the present invention, a glow plug tip temperature Tg is calculated as $Tg=Cg\times Rg-Koff$.

Here, Cg is a constant that is determined by an electrical characteristic of the glow plug 1. More specifically, Cg is a constant representing the relationship between the temperature and the resistance of the glow plug 1. The value of Cg is determined by the shape, material, and so forth of each part configuring the glow plug 1.

Further, Rg is the value of the glow plug resistance that was obtained in step S104.

Additionally, Koff is an offset quantity. This offset quantity is determined as a value that offsets drift arising because of a change in the heater reference point temperature in the $Cg\times Rg$ portion of the arithmetic expression for obtaining the glow plug tip temperature Tg. In the embodiment of the present invention, this offset quantity is calculated and determined by a regression calculation or the like as a function of the heater reference point temperature.

Additionally, the relationship between the heater reference point temperature and the offset quantity is made into an offset quantity calculation-use table or an arithmetic expression, is stored beforehand in an appropriate storage region of the arithmetic and control unit 23, and is used for the glow plug tip temperature Tg.

The arithmetic expression for obtaining the glow plug tip temperature Tg was obtained as a result of devoted efforts by the present inventor described next.

First, the correlation between glow plug tip temperature and glow plug resistance is expressed as a linear correlation, or in other words a linear function, and the present inventor was able to deduce from the results of tests and so forth that the correlation drifts in the Y-axial direction of the coordinate plane depending on the temperature of the glow plug 1 itself.

As a result of performing, on the basis of the aforementioned knowledge, devoted tests and so forth to make this drift substantially offsettable regardless of the temperature of the glow plug 1 itself, the present inventor came to the conclusion that adding the offset that is expressed as a function resulting from the heater reference point temperature described above to the linear function as a negative element is effective. As a result, this led to obtaining the above calculation expression of the glow plug tip temperature Tg.

The glow plug tip temperature Tg that has been obtained as described above is stored in an appropriate storage region of the arithmetic and control unit 23 and is supplied for energization control of the glow plug 1 and fuel injection control as needed.

After the calculation of the glow plug tip temperature Tg, it is determined whether or not a glow plug OFF flag, which is a flag for judging whether or not it is necessary to stop the energization of the glow plug 1, has been set—that is, whether or not the value of the glow plug OFF flag is a predetermined value (e.g., "1") that corresponds to stopping the energization of the glow plug 1 (see step S112 in FIG. 4).

Whether or not it is necessary to energize the glow plug 1 is judged in the same-as-conventional glow plug energization control processing that is executed by the arithmetic and control unit 23 and was taken as a precondition before, and the glow plug OFF flag is set as needed.

Then, in a case where it has been determined in step S112 that the glow plug OFF flag has been set (in the case of YES), that is, in a case where it has been determined that it is necessary to stop the energization of the glow plug 1, the energization of the glow plug 1 is stopped, the series of processing steps is ended, and the arithmetic and control unit 23 returns to an unillustrated main routine.

In a case where it has been determined in step S112 that the glow plug OFF flag has not been set (in the case of NO), that is, in a case where it has been judged that it is not necessary to stop the energization of the glow plug 1, the arithmetic and control unit 23 returns to step S102 and the series of processing steps is repeated.

In the above embodiment, the temperature of the heating element negative electrode connecting portion 3*a* directly acquired by the thermocouple 36 is used as the heater reference point temperature, but it is not necessary for the heater reference point temperature to be limited to this. It is also suitable to use the temperature of another site—for example, the tip portion of the metal sheath 3—excluding the neighborhood of the heating element 7 of the glow plug 1.

Moreover, rather than a method of directly acquiring the heater reference point temperature with a thermocouple or the like, for example, a physical quantity that has been acquired by any of various sensors that are conventionally attached to a vehicle, such as, for example, engine cooling water temperature, engine speed, air intake volume, air intake temperature, etc., or the EGR rate, which is arithmetically calculated on the basis of various detection signals, or combustion pressure, etc., may also be substituted, converted to the heater reference point temperature, and used.

Here, the analysis relating to the relationship between the temperature and the resistance of a glow plug by the present inventor that led to deducing the present invention generally referred to above will be more specifically described with reference to FIG. 6 to FIG. 8.

Figure 6:
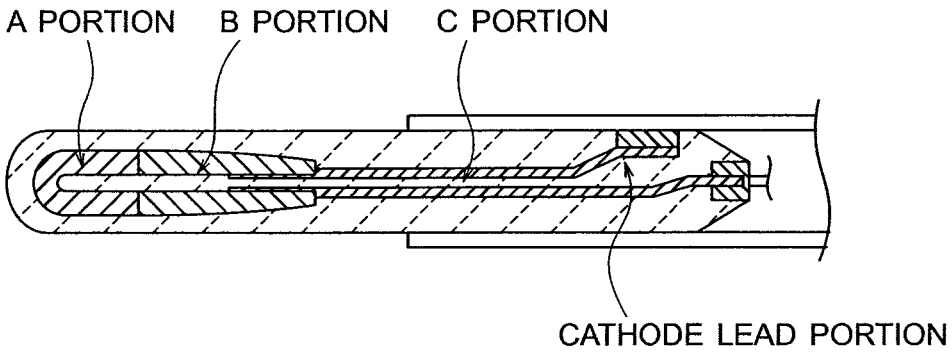
FIG. 6 is a longitudinal sectional view schematically showing the general configuration of a glow plug.

As shown in FIG. 6, a glow plug can be broadly divided into three portions: an A portion resulting from the heating element resulting from a ceramic resistor or the like; a C portion resulting from metal lead wires or the like; and a B portion that is a portion interconnecting the A portion and the C portion.

Figure 7:
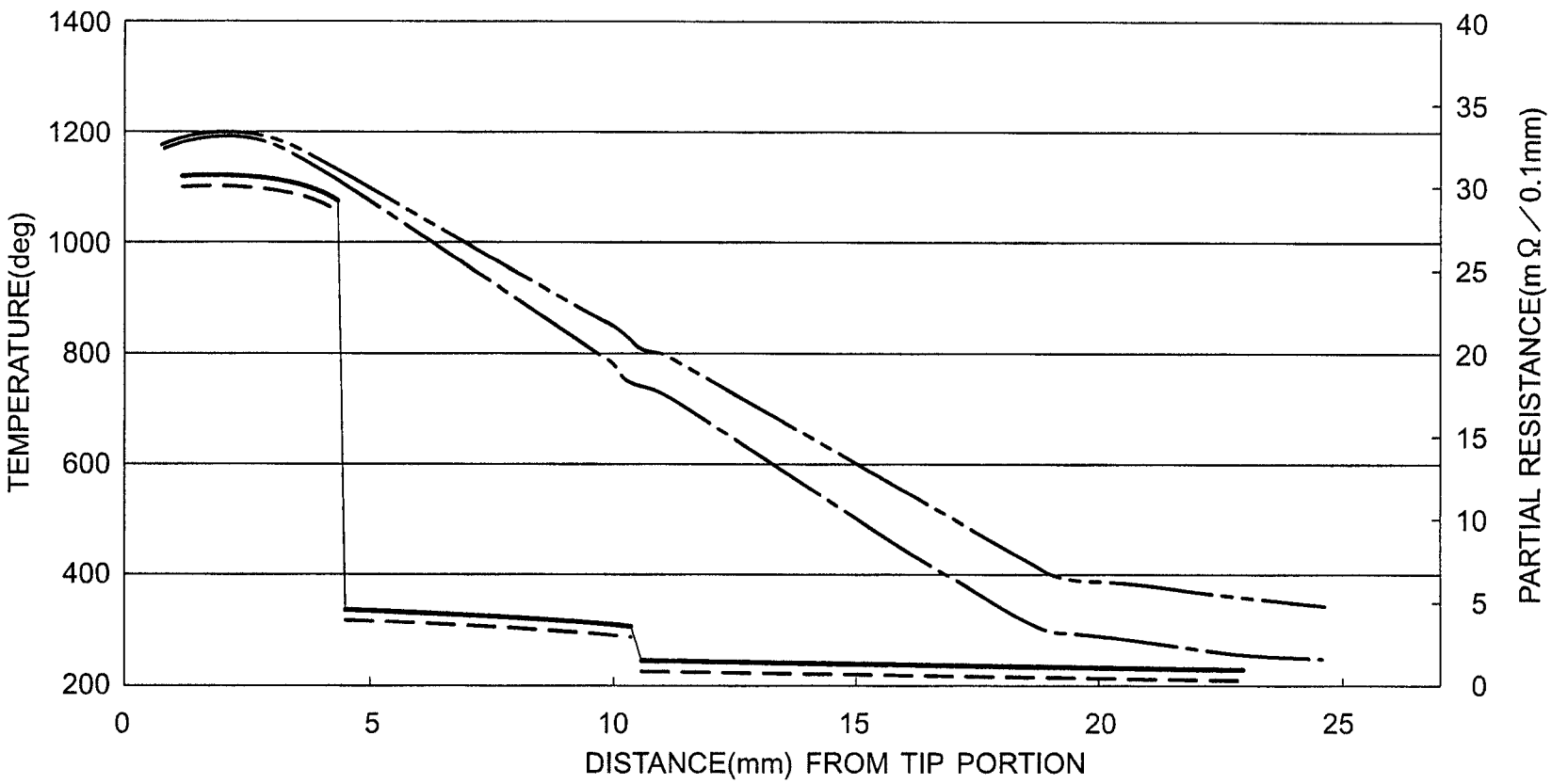
FIG. 7 is a characteristic line diagram showing the relationship between distance from a tip portion, resistance, and temperature in the glow plug of the configuration shown in FIG. 6.

FIG. 7 shows an example of the partial resistances of the A portion, the B portion, and the C portion in this glow plug and an example of the temperature distribution in the lengthwise axial direction of the glow plug.

In FIG. 7, the horizontal axis represents distance from the tip portion (the A portion side) of the glow plug, the vertical axis on the right side represents partial resistances when the heater circuit (a circuit configured by the series connection of the A portion, the B portion, and the C portion) has been divided into units of 0.1 mm units, and the vertical axis on the left side represents temperature.

In FIG. 7, the solid line represents the partial resistance distribution when the temperature of the tip is 1200° C. and the temperature of the cathode lead portion is 350° C. The dashed line represents the partial resistance distribution when the temperature of the tip is 1200° C. and the temperature of the cathode lead portion is 250° C. In FIG. 7, these two characteristic lines are slightly apart from each other in order make the drawing easier to see, but in actuality they are virtually superimposed.

The characteristic lines resulting from the solid line and the dashed line show that the resistances in the A portion, the B portion, and the C portion differ because of differences in materials and so forth. That is, the range until the distance from the tip portion is approximately 5 mm represents the resistance of the A portion, and the partial resistance per 0.1 mm unit length is around about 30 mΩ.

Further, the range where the distance from the tip portion is approximately 5 mm to 10 mm represents the resistance of the B portion, and the partial resistance per 0.1 mm unit length is around about 5 mΩ. Additionally, the portion where the distance from the tip portion is approximately 10 mm or more represents the resistance of the C portion, and the partial resistance per 0.1 mm unit length is around about 2 mΩ.

Further, in FIG. 7, the double-dashed chain line characteristic line represents the temperature distribution in the lengthwise axial direction of the glow plug when the temperature of the tip is 1200° C. and the temperature of the cathode lead portion is 350° C., and the single-dashed chain line characteristic line represents the temperature distribution in the lengthwise axial direction of the glow plug when the temperature of the tip is 1200° C. and the temperature of the cathode lead portion is 250° C.

Normally it is possible to measure the temperature distribution in the lengthwise axial direction of the glow plug with a radiation thermometer, for example, but it is impossible to perform this measurement in a state in which the glow plug has been attached to the engine.

Therefore, the present inventor arrived at deducing a method of estimating the glow plug tip temperature from the glow plug resistance and the temperature of a reference point with the following model.

First, as shown in FIG. 6, the present inventor assumed a heater circuit where materials with different characteristics are series connected from the tip side as a heating portion A, a lead portion B, and a lead portion C. The present inventor hypothetically assumed that each portion in the circuit is a unit of a single cross-sectional area and a unit length. Additionally, assuming that Tg represents the temperature at the time of energization at a given portion, Tr represents room temperature which becomes a reference, Rr represents resistance at room temperature, and C represents a resistance temperature coefficient, then the partial resistance Rg can be expressed as $Rg=Rr\{1+C(Tg-Tr)\}$. So the resistance ΣRg of the entire heater circuit at this time can be expressed as $\Sigma Rg=\Sigma Rra\{1+Ca(Tga-Tr)\}+\Sigma Rrb\{1+Cb(Tgb-Tr)\}+\Sigma Rrc\{1+Cc(Tgc-Tr)\}$.

Here, Ca, Cb, Cc, Tr, Rra, Rrb, and Rrc are already known, so it suffices for ΣRg, Tgb, and Tgc to be solved in order to obtain Tga.

In a case where Tgb and Tgc small enough that they can be ignored compared to Tga, then ΣRg can be approximated as $\Sigma Rg\approx\Sigma Rra\{1+Ca(Tga-Tr)\}$, but at the time of glow plug energization, there is electrothermal action and so Tgb and Tgc cannot be ignored. On the contrary, Tgb and Tgc change greatly depending on the operating state of the engine and in no small way affect ΣRg. On the other hand, Tgb exists on a line joining Tga and Tgc regardless of the operating state of the engine, so it is relatively easy to estimate Tgb from Tgc. That is, as a result, it becomes possible to precisely estimate Tga from ΣRg and Tgc.

Figure 8:
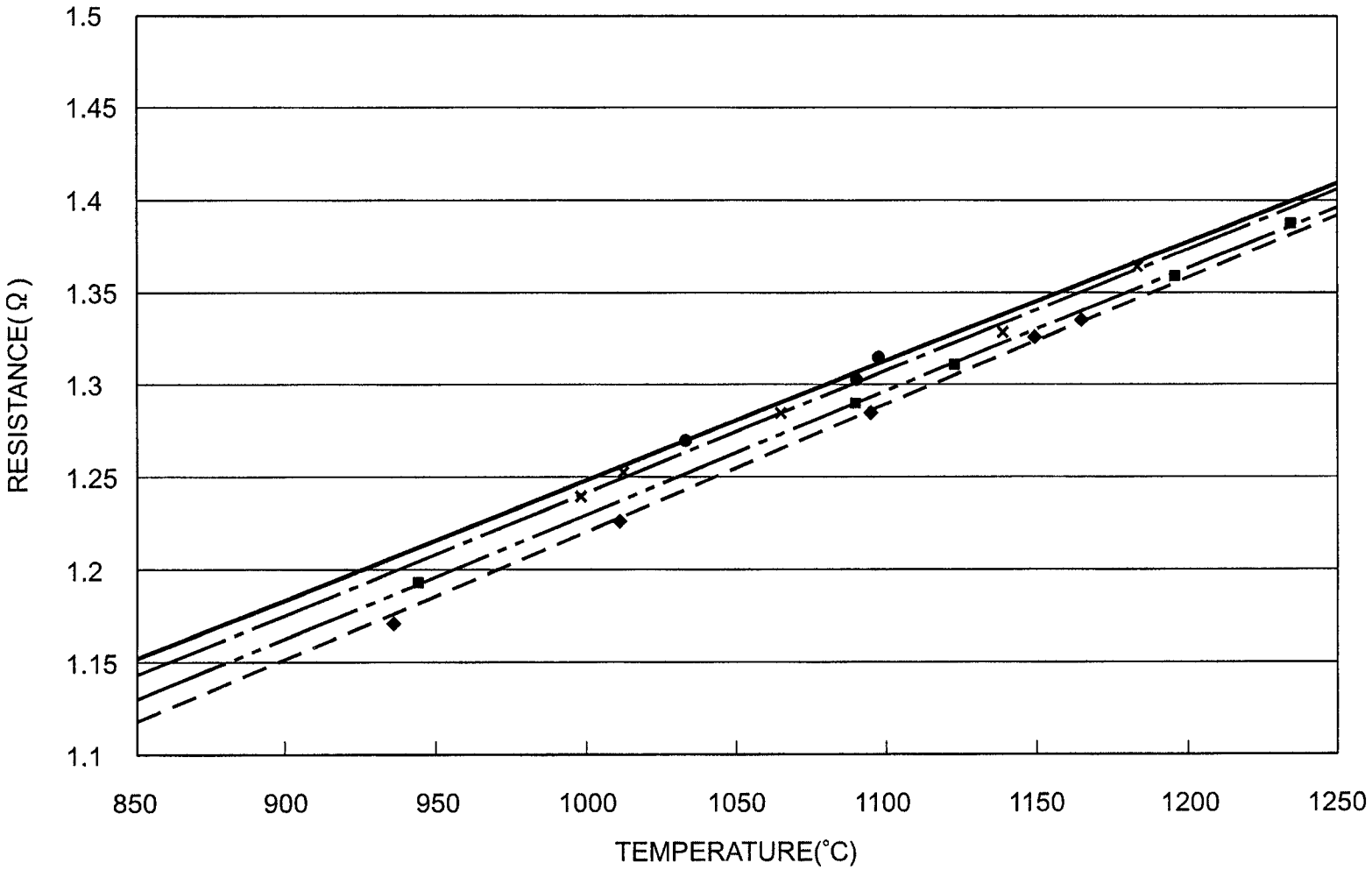
FIG. 8 is a characteristic line diagram showing the relationship between glow plug resistance and glow plug tip temperature in the glow plug of the configuration shown in FIG. 6.

In FIG. 8, there is shown an example of characteristic lines representing the correlation (called "master curve" below) between glow plug resistance and glow plug tip temperature in cases where the cathode lead portion (see FIG. 6) is taken as a reference point and the temperature of the reference point has been sectioned in 25° C. intervals (275° C. to 300° C., 300° C. to 325° C., 325° C. to 350° C., 350° C. to 375° C., 375° C. to 400° C., and 400° C. to 425° C.).

In FIG. 8, the dashed line characteristic line represents the correlation between glow plug resistance and glow plug tip temperature in a case where the reference point temperature is in the range of 275° C. to 300° C., the double-dashed line characteristic line represents the correlation between glow plug resistance and glow plug tip temperature in a case where the reference point temperature is in the range of 300° C. to 325° C., the single-dashed line characteristic line represents the correlation between glow plug resistance and glow plug tip temperature in a case where the reference point temperature is in the range of 375° C. to 400° C., and the solid line characteristic line represents the correlation between glow plug resistance and glow plug tip temperature in a case where the reference point temperature is in the range of 400° C. to 425° C.

In FIG. 8, in regard to the range where the reference point temperature is 325° C. to 350° C. and the range where the reference point temperature is 350° C. to 375° C., these substantially overlap the characteristic lines in the reference point temperatures around these and it becomes difficult to distinguish between them, so these characteristic lines are omitted from the standpoint of making it easier to see the drawing and facilitating understanding.

According to FIG. 8, it can be understood that in a case where the cathode lead portion temperature is different, drift in the master curve arises because of the difference in the temperature distribution in the lengthwise axial direction of the glow plug and it is difficult to estimate the temperature of the tip of the glow plug with only the resistance of the glow plug.

As a result of performing various tests and so forth in light of this characteristic, the present inventor arrived at deducing that drift in the master curve can be substantially cancelled if the glow plug resistance and the temperature of the reference point are clearly known, and on the basis of this result the present inventor made the temperature of the tip of the glow plug estimable with high precision by the processing procedure described in FIG. 4 above.

Figure 5:
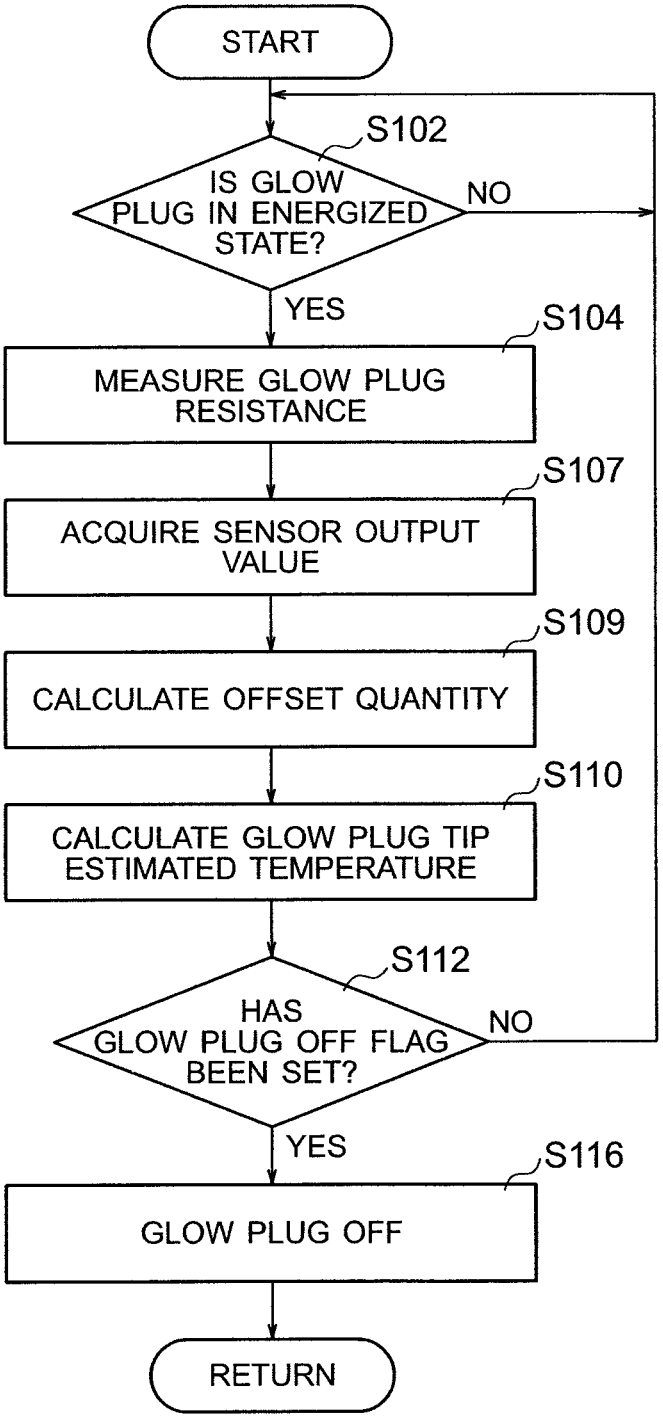
FIG. 5 is a subroutine flowchart showing a procedure in a second example of the glow plug tip temperature estimation process that is executed by the glow plug drive control device shown in FIG. 3.

In FIG. 5, as a second example, a processing example in the case of substituting, as a heater reference point temperature, a physical quantity that has been acquired by a sensor is shown as a subroutine flowchart. The content thereof will be described below with reference to FIG. 5.

The same reference numerals will be given to steps having the same processing content as the steps shown in FIG. 4, detailed description of those same steps will be omitted, and the points that are different will be centrally described below.

When processing by the arithmetic and control unit 23 is started, like in the first example shown in FIG. 4, it is determined whether or not the glow plug 1 is being energized (see step S102 in FIG. 5). When it is determined that the glow plug 1 is being energized, a measurement of the resistance of the glow plug 1 is executed (see step S104 in FIG. 5).

Next, as a substitute for the heater reference point temperature, an output signal of a sensor (not shown) is imported into the arithmetic and control unit 23 and stored in an unillustrated appropriate storage region (see step S107 in FIG. 5).

Here, any of various sensors that are conventionally attached to a vehicle are suitable as the sensor; for example, a water temperature sensor for detecting the engine cooling water temperature, a speed sensor for detecting the engine speed, and an air intake sensor for detecting the air intake volume are suitable.

Next, a calculation of the offset quantity Koff is performed on the basis of the sensor output value that was acquired in step S104 (see step S109 in FIG. 5).

In the calculation of the offset quantity Koff, first, the sensor output value is converted into the heater reference point temperature—for example, the temperature in the heating element negative electrode connecting portion 3*a*—using a predetermined conversion expression. Here, the predetermined conversion expression is set on the basis of tests, simulation results, and so forth in regard to the correlation between the sensor output value and the heater reference point temperature.

After the heater reference point temperature has been calculated, the offset quantity Koff is obtained from the heater reference point temperature like in S108 shown in FIG. 4.

Then, the glow plug tip temperature Tg is calculated as $Tg=Cg\times Rg-Koff$ (see step S110 in FIG. 5). The calculated value is stored in an appropriate storage region of the arithmetic and control unit 23 and is supplied for energisation control of the glow plug 1 and fuel injection control as needed.

According to the present invention, the temperature of the tip portion of the glow plug can be estimated using the actually measured resistance value of the glow plug and the temperature of the arbitrary site excluding the tip portion of the glow plug, whereby the invention achieves the effects that, in contrast to conventional, the temperature of the tip portion of the glow plug can be simply and precisely estimated and it is also not necessary to consider high heat resistance for an adhesive adhering a thermocouple because it is not necessary to adopt a configuration where a thermocouple is disposed in the tip portion of the glow plug, which contributes to a reduction in cost.

The present invention is suited for fuel injection control systems and so forth in vehicles where the estimated temperature of a glow plug tip whose precision is higher compared to conventional is desired.

What is claimed is:

1. A glow plug drive control device comprising:

an arithmetic and control unit that executes a drive control of a glow plug; and an energization drive circuit that performs energization of the glow plug in response to the drive control of the glow plug executed by the arithmetic and control unit, wherein the arithmetic and control unit is configured to arithmetically calculate a resistance value of the glow plug based on an energization current of the glow plug and a voltage applied to the glow plug, measure a heater reference point temperature, calculate an offset with a predetermined offset arithmetic expression based on the heater reference point temperature, perform a multiplication of a calculated resistance value of the glow plug and a predetermined constant based on an electrical characteristic of the glow plug, correct the multiplication result with the offset, and calculate an estimated temperature of a tip of the glow plug based on the corrected multiplication result, wherein the heater reference point temperature is the temperature of an arbitrary site excluding the neighborhood of a heating element of the glow plug, and the predetermined offset arithmetic expression is determined such that a value offsets a drift resulting from a change in the heater reference point temperature, and the predetermined constant based on the electrical characteristic of the glow plug is calculated as a function of the heater reference point temperature, and wherein the arithmetic and control unit is further configured to input the temperature of the arbitrary site excluding the neighborhood of the heating element of the glow plug;

input an output of a sensor that is installed in a vehicle; and calculate, on the basis of a predetermined correlation between the sensor output and the temperature of the arbitrary site excluding the neighborhood of the heating element of the glow plug, the temperature of the arbitrary site excluding the neighborhood of the heating element of the glow plug that corresponds to the sensor output.

2. The glow plug drive control device of according to claim 1, wherein the heater reference point temperature is measured by a thermocouple.

3. The glow plug drive control device of according to claim 2, wherein the thermocouple is located proximal to a housing of the glow plug, and wherein the thermocouple measures the temperature of the housing of the glow plug.

4. The glow plug drive control device of according to claim 3, wherein the housing includes a heating element negative electrode connecting portion.

* * * * *